United States Patent [19]

Rabuse

[11] Patent Number: 4,690,092

[45] Date of Patent: Sep. 1, 1987

[54] AQUATIC SCRUBBING DEVICE

[76] Inventor: Milton Rabuse, 249-32 57th Ave., Little Neck, N.Y. 11362

[21] Appl. No.: 871,452

[22] Filed: Jun. 5, 1986

[51] Int. Cl.[4] ..... B63B 59/00

[52] U.S. Cl. ..... 114/222; 15/180

[58] Field of Search ..... 114/222; 51/24, 428–430; 15/180; 180/8.1, 8.3, 8.5, 8.6

[56] References Cited

U.S. PATENT DOCUMENTS 4,029,164 6/1977 Urakami ..... 114/222

FOREIGN PATENT DOCUMENTS 115567 2/1969 Norway ..... 114/222

*Primary Examiner*—Joseph F. Peters, Jr.
*Assistant Examiner*—Jesûs D. Sotelo
*Attorney, Agent, or Firm*—Abelman Frayne Rezac & Schwab

[57] ABSTRACT

An aquatic scrubbing device for attachment to an underwater ferro-magnetic surface incorporates a carriage, at least two independently energizable electromagnets supported by the carriage for rotation about mutually parallel axes, and at least one drive motor for rotating the electromagnets relative to the carriage, whereby alternative energization of the electromagnets and the drive motors will cause a walking motion of the carriage when attached to the ferro-magnetic surface, the device incorporating rotatable scrubbers for removing aquatic growths from that surface.

4 Claims, 9 Drawing Figures

FIG. 4
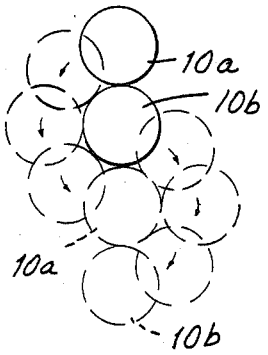
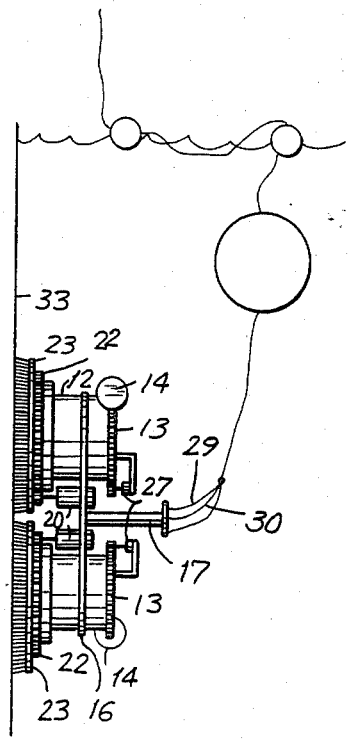
FIG. 5
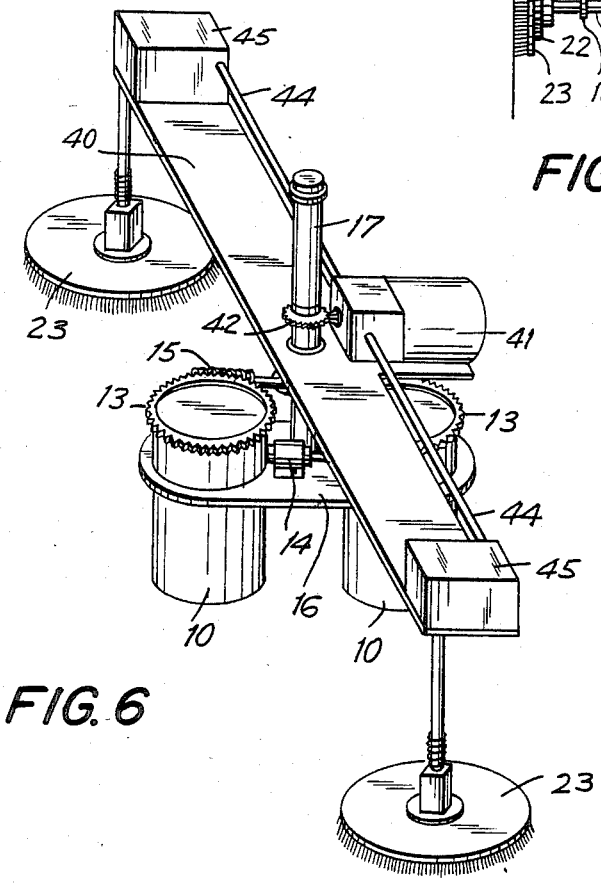
FIG. 6

AQUATIC SCRUBBING DEVICE

FIELD OF THE INVENTION

This invention relates to a scrubbing device for aquatic use, and has particular application to such a device for use in removing aquatic growths from ferro-magnetic hulls of ships or boats. Such growths commonly include algae, aquatic plants, mussels and barnacles, the presence of which greatly increases the drag imposed on the ship, and in turn, greatly increases the fuel costs incurred in propelling the ship. The aquatic scrubber of the present invention is not limited to this use, but also finds application in any instance in which underwater scrubbing of a ferro-magnetic surface is required, for example, in the cleaning of any fixed or floating structures formed from ferro-magnetic material, such as underwater supports for an oil drilling rig or the like, or a floating platform or barge.

BACKGROUND OF THE INVENTION

Power drive aquatic scrubbing devices are well-known in the art, typical examples being shown in U.S. Pat. No. 4,314,521, Lundberg and U.S. Pat. No. 4,084,535, Rees. These devices, while admirable for their intended purpose, require the personal attendance of a diver for controlling the movements of the device, and, for manipulating it onto and over the surface to be cleaned. Clearly, the involvement of a diver results in an increase in the expense of the cleaning operation. Additionally, the apparatus involves brushes rotating at considerable speed and which constitute a hazard to the diver and are difficult to handle.

Various devices have been proposed for magnetic attachment to a ferro-magnetic surface, and which can be moved over that surface, such surfaces including the ferro-magnetic hulls of ships. The devices are primarily employed in maintenance of the ship's hull, including painting and scraping at the time the ship is dry-docked. Typical examples of such devices are to be found in U.S. Pat. No. 3,960,229, Shio, and U.S. Pat. No. 2,104,062, Temple. Such devices are limited in their use to movement over a ship's hull exclusively in a linear direction with a rolling motion, and must be removed from the hull and repositioned for them to traverse an adjacent area. Tibbling, U.S. Pat. No. 3,609,612, teaches a magnetic device having steerable rollers in order that it may change direction when moving over a ferro-magnetic surface, such as a ship's hull. This device, however, has no practical utility in the cleaning of the ship's hull.

SUMMARY OF THE INVENTION

According to the present invention there is provided a scrubbing device which is attachable to a ship's hull by electromagnets, and which is capable of moving randomly over the ship's hull in a walking motion.

The device includes at least two electromagnets that are selectively energizable, and which are attached to a carriage for rotation relative thereto about mutually parallel axes. One or more drive motors are provided for rotating the electromagnets relative to the carriage, such that, with one of the electromgnets energized and in clamping engagement with the ferro-magnetic surface, the carriage can be driven in an arcuate movement about the axis of that electromagnet, and, in so doing, reposition the other or others of the electromagnets on the ferro-magnetic surface.

After the termination of the movement of the carriage about the axis of the first mentioned electromagnet, the other electromagnet is energized to clamp it to the ferro-magnetic surface, and the first electromagnet is de-energized. The carriage is then driven in an arcuate movement about the axis of the other electromagnet, thus repositioning the first electromagnet on the ferro-magnetic surface. The first electromagnet is then again energized to clamp it to the ferro-magnetic surface, and the second electromagnet is de-energized, thus readying the carriage for further arcuate movement about the axis of the first electromagnet.

By controlling the extent of arcuate movement of the carriage about the axis of the respective electromagnets, the device can be caused to move in a substantially straight line across the ship's hull, or follow a curved line, or to move at a right angle or other angle relative to its previous direction of travel, or, to reverse itself by moving through 180° and then traverse a line parallel to its initial direction of movement.

In this manner, the entire surface of a ship's hull can be traversed merely by chaning the direction of movement of the device, without removing the device from that surface.

According to a prefered embodiment of the invention, the scrubbing brushes are annular and are journalled for rotation concentrically on the electromagnets. The scrubbing brushes are driven for rotation relative to their associated electromagnets, such that a driven one of the scrubbing brushes is caused to traverse an arcuate path on each angular reorientation of the carriage about the axis of the electromagnetic at that time energized.

According to another embodiment of the invention, the carriage supports rotatable arms carrying power driven scrubbing brushes, whereby the ferro-magnetic surface is scrubbed continuously as the device is traversed over that surface.

In an alternative of this embodiment, the scrubbing brushes are moved radially along the arms, whereby the scrubbing brushes are moved in an Archimedean spiral across the ferro-magnetic surface.

According to another embodiment of the invention, the carriage is formed as a circular member having a perimetric circular track, and the scrubbing brushes and the power drives are supported by arms radial to the circular carriage, and which are retained within and movable along the said perimetric track of the circular carriage.

DESCRIPTION OF THE DRAWINGS

The invention will now be described with reference to the accompanying drawings which are illustrative of preferred embodiments of the invention, and in which:

FIG. 4 is a diagram demonstrating the manner in which the device can be caused to walk;

FIG. 5 illustrates the manner in which the device is to be attached to a ferro-magnetic surface, such as the hull of a ship;

FIG. 6 is a perspective view of an alternative embodiment of the device.

DESCRIPTION OF THE PREFERRED EMBODIMENTS

Figure 1:
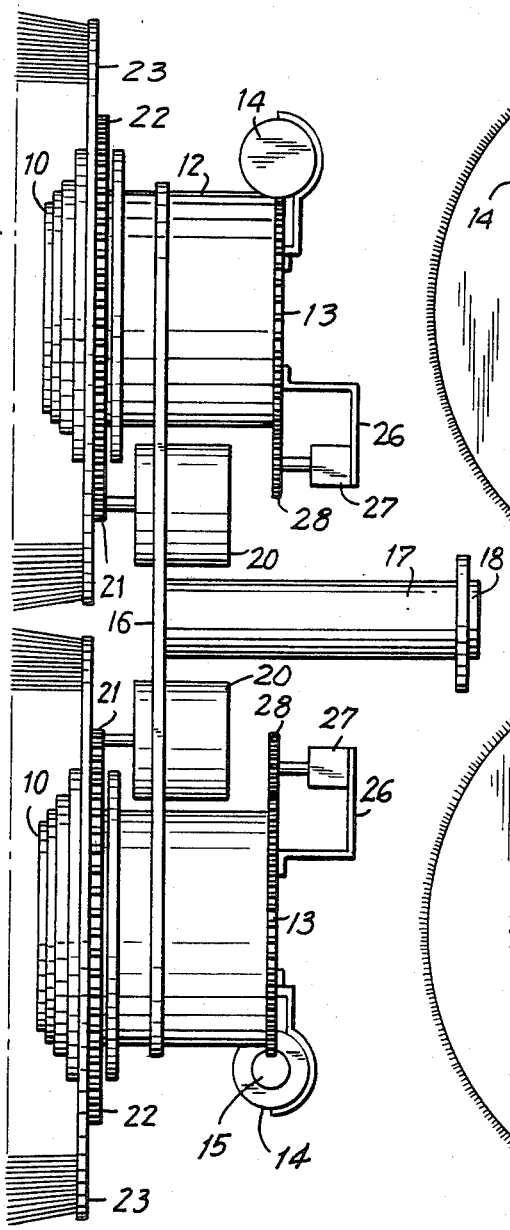
FIG. 1 is a side elevation of one preferred form of aquatic scrubber according to the present invention.
Figure 2:
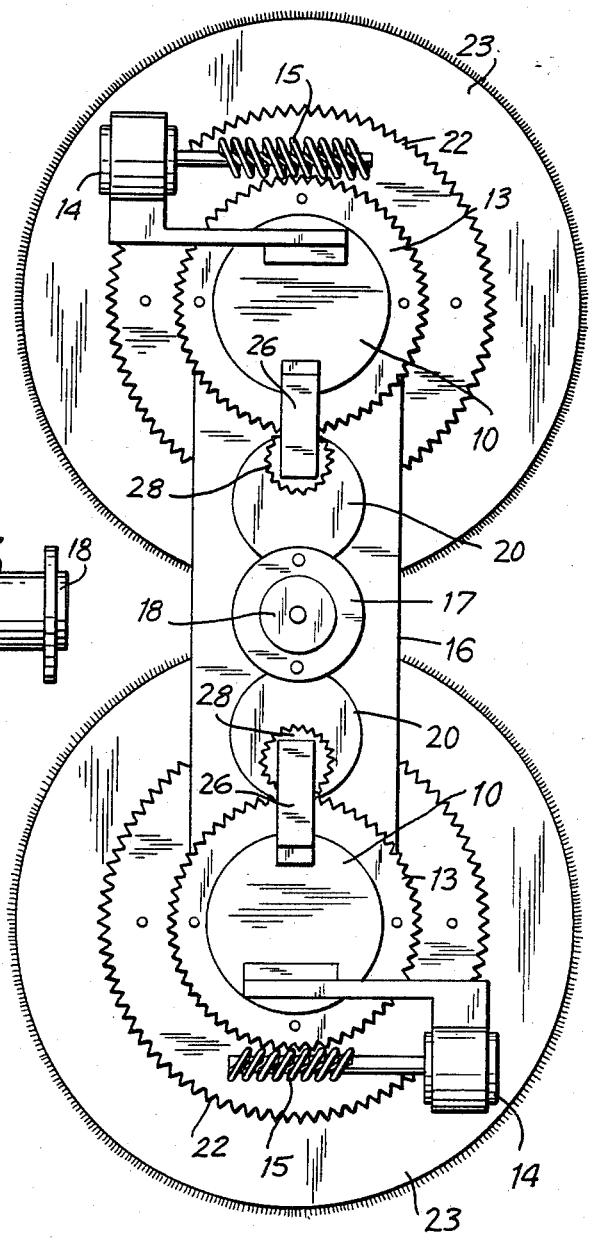
FIG. 2 is a front elevation thereof.
Figure 3:
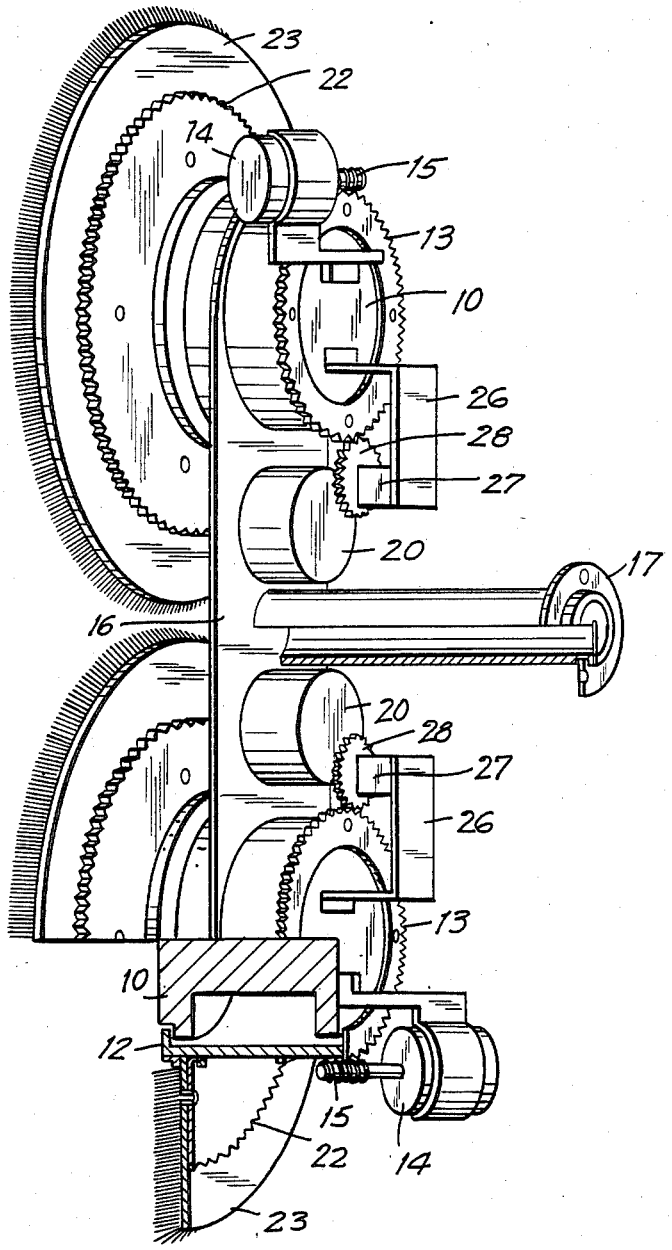
FIG. 3 is a fragmentary perspective view thereof.

Referring firstly to FIGS. 1, 2, and 3, the aquatic scrubbing device of the present invention includes at least two electromagnets 10, which are selectively energizable such that, at all times when in the working position, at least one of the electromagnets is energized and in clamping engagement with an adjacent ferro-magnetic surface of, for example, a ship's hull. As previously explained, the ferro-magnetic surface equally well it could be a submerged surface of a floating platform or barge, or underwater supports for an oil drilling rig, etc.

The respective electromagnets 10 are supported for rotation within housings 12 and are respectively driven for rotation about their central longitudinal axis by electrical motors 14 driving worm gears 15.

The housings 12 are rigidly attached to a carriage 16, which in this embodiment is provided with a laterally extending post 17 intermediate its ends. The post 17 is provided for lifting or lowering of the device, and also provides a convenient connection 18 for the umbilical cord 30 of the electrical control circuit later described with reference to FIG. 7.

Mounted on the carriage 16 are electrical drive motors 20, which respectively drive spur gears 21 engaged with ring gears 22 journalled for rotation concentrically about the respective electromagnets 10. The respective ring gears 22 are fast with and drive annular brushes 23. Fast with the respective housings 12 are support arms 26 which respectively carry position switches 27, the position switches being driven respectively by spur gears 28 engaged with the ring gears 13 employed for rotating the electromagnets 10 about their longitudinal axis.

In use of the device, it is lowered over the side of the ship, is correctly oriented to bring the electromagnets into juxtaposition with the ship's hull, and then one or both of the electromagnets is energized to cause the device to clamp onto the ship's hull. This conveniently can be done at a position above the water line, in that the device is fully mobile over the ship's hull, and, can be caused to walk downwardly across the ship's hull for it to become submerged.

This walking motion is produced, as illustrated diagramatically in FIG. 4, by energizing one of the electromagnets 10, and by de-energizing the other electromagnet 10. Upon energization of the said one of the electromagnets 10, the associated drive motor 14 is energized to rotate its associated worm gear 15, and thus move the carriage 16 angularly.

As the energized electromagnet 10 is at that time clamped to the ship's hull by magnetic attractions, the resultant of the driving force produced by the energized drive motor 14 is to cause the carriage 16 to move in an arc about the axis of the energized electromagnet.

After the carriage has, for example, moved through 180°, the drive motor 14 of the energized electromagnet is then de-energized; both of the electromagnets 10 are then energized so that both of the electromagnets are magneticaly clamped to the ship's hull; the previously energized electromagnet is then de-energized; and, the drive motor 14 associated with the other and now energized electromagnet is energized, this in turn causing the carriage 16 then to move arcuately about the then energized electromagnet 10.

In the event that the then arcuately moving electromagnet encounters an obstruction, such as a welding bead, the associated rotating brush will act to lift it over that bead, sufficient play being provided in the mounting of these electromagnets on the carriage.

These movements of the carriage cause rotation of the spur gears 28 associated with the respective position switches 27, the position switches 27 in turn being employed to provide a reading of the extent of angular displacement of the carriage 16 about the then energized electromagnet 10. Thus, a positive indication can be obtained at the control of the apparatus as to the orientation of the device, even though it may be at that time submerged and not directly viewable.

FIG. 4 illustrates diagramatically the manner in which the walking motion of the device is accomplished. For example, with the electromagnet 10*b* energized and the electromagnet 10*a* de-energized, the carriage will be driven in a direction to cause the electromagnet 10*a* to move from its initial full-line position downwardly through 180° to its position indicated in dotted lines. At this point the electromagnet 10*a* is energized and the electromagnet 10*b* is subsequently de-energized. Then, by driving the carriage about the electromagnet 10*a*, the electromagnet 10*b* is caused to move from its full position to the position indicated in dotted lines.

The angular displacement of one of the electromagnets about the other is controllable from the surface, with the option of moving the carriage about the then energized electromagnet 10 by any angular displacement up to 360°. Thus, by terminating the angular displacement at 90°, the device can be cause to change its direction of movement from the generally vertical direction illustrated in FIG. 4 to movement in a generally horizontal direction. By moving the carriage angularly about 270°, the device can be caused to re-position itself for movement parallel to the original direction of movement, and in the opposite direction, such that the device successively traverses adjacent parallel areas of the ship's hull.

During these arcuate movements of the carriage 16, the rotary brush associated with the then de-energized magnet is driven by its associated drive motor 20, thus scrubbing and scouring the ship's hull as the carriage moves angularly from one position to the other. The drive motor of scrubbing brush associated with the other electromagnet is then energized, at the time its associated electromagnets is de-energized, similarly producing a sweep of the scrubbing brush associated with the then de-energized electromagnet across the surface of the ship's hull.

Thus, by appropriate control of the respective drive motors in relationship to energization of the respective electromagnets, the device can be caused to walk in any random direction across the exterior of the ship's hull, there being no requirements for the ship to be dry-docked during this operation. Conveniently, the scrubbing device can be used at any point of call of the vessel during loading and unloading of the vessel, its use involving minimal expense and employing relatively unskilled labor.

As the device is magnetically attached to the ship's hull, there is a possibility that the device could be irretrievably lost in the event that its power supply was to be temporarily or accidentally disconnected. To prevent this from happening, the device is attached by its post 17 to hawser 29, which conveniently also can support the umbilical 30 for the device, the hawser being attached to floats 22. Should an electrical failure occur, the device will drop off the hull 33 of the ship, but is held captive by the hawser 29. It is, thus, only a matter of retrieving the device by the hawser and reattaching the device to the ship's hull once the electrical supply has been re-established.

Referring now to FIG. 6, there is shown an alternative embodiment of the device, the operation of the device being identical in all respects with previously described with reference to FIGS. 1 through 5.

In FIG. 6, the respective brushes 23 are mounted independently of the elctromagnets 10, and are carried by a separate carriage 40 which is journalled on the post 17 for angular movement about the axis of the post 17. This angular movement is produced by energization of a motor 41 driving the secondary carriage 40 through a reduction gear train 42 reacting on the post 17, and which simultaneously rotates the respective brushes 23 through drive shafts 44 and gear box transmissions 45.

In FIG. 6, the walking motion of the electromagnets 10 and their associated carriage 16 is produced in exactly the same manner as that previously described. In FIG. 6, both of the brushes 23 can be rotated at the same time to effect the required scrubbing action on the ship's hull, the respective brushes moving orbitally about the carriage 16, both when the carriage 16 is stationary, or, when it is moving arcuately about the energized one of the electromagnets 10.

Figure 7:
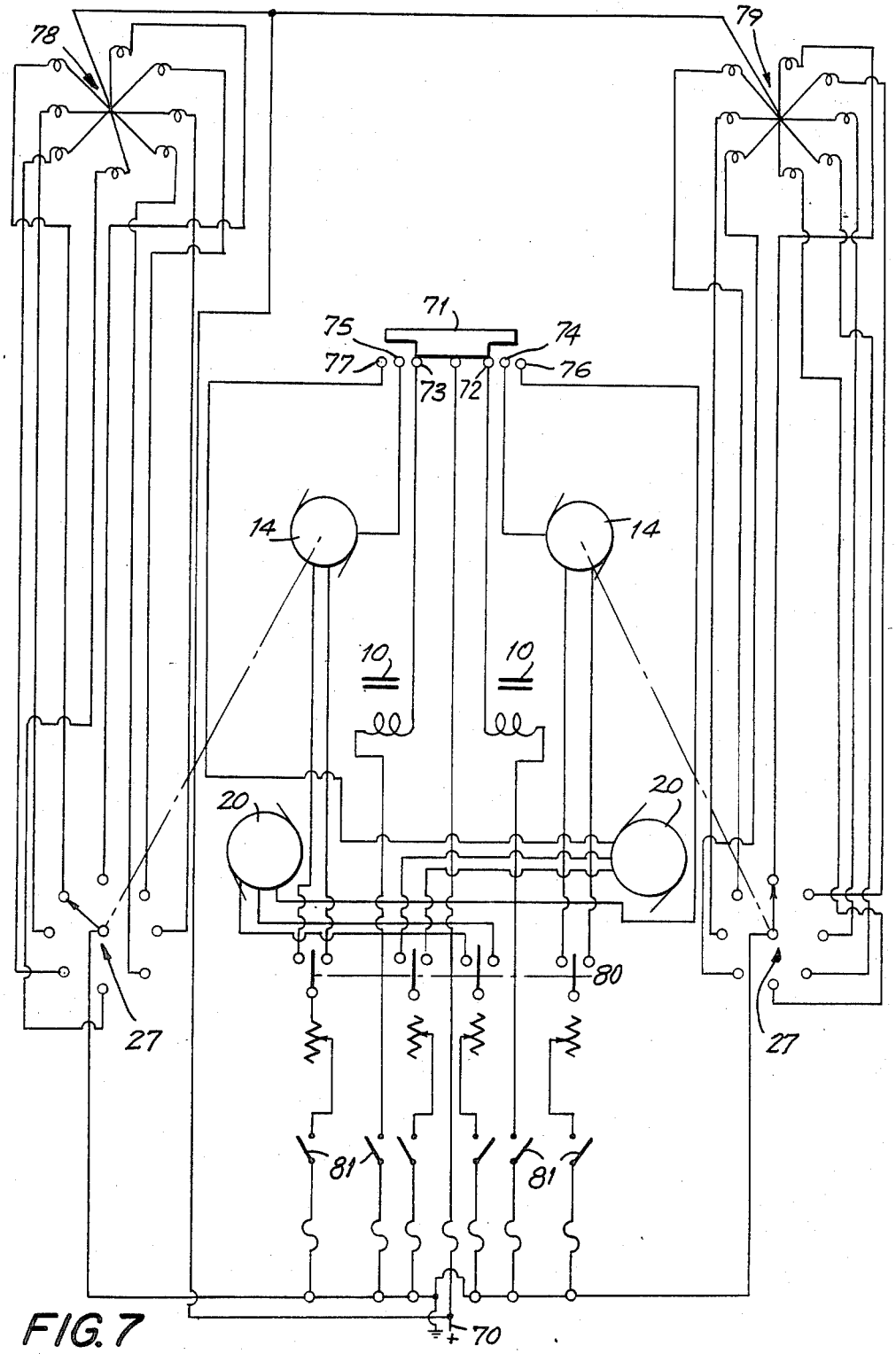
FIG. 7 is a schematic electrical circuit of a control usable with the embodiments of FIGS. 1 through 7.

Referring now to FIG. 7, there is shown the schematic of an electrical circuit, which can be employed to control the movements of the respective members of each of the embodiments of FIGS. 1 through 6, either in its form illustrated, or, with minor modifications as later discussed.

Referring to FIG. 7, one leg 70 of an AC or DC supply extends to and is in continuous contact with a manually operable switch bar 71. The switch bar 71 is, of course, formed from electrically conductive material. The switch bar 71 is illustrated in FIG. 7 in an intermediate position, in which position it bridges contacts 72 and 73 of the electromagnets 10. Thus, in this position both electromagnets are energized, the remaining contacts being open circuited.

On movement of the switch bar 71 to the left, the contact 72 of one of the electromagnets 10 opens, the switch contact 73 of the other electromagnet remaining closed, and maintaining that electromagnet energized. The switch contact 75 then closes, thus energizing the directional drive motor 14 of the then energized electromagnet. Immediately thereafter, the switch contact 77 closes, this establishing a circuit to the drive motor 20 associated with the brush of the then de-energized electromagnet. At this point, the carriage proceeds to move angularly around the axis of the energized electromagnet, the brush associated with the de-energizing electromagnet moving arcuately with the carriage and effecting a scrubbing action on the hull of the ship.

Angular movement of the carriage under the control of the then energized directional drive motor produces rotation of the position switch 27 associated with the then energized electromagnet, the position switch being employed to activate a display device 78 positioned at the surface, and which indicates to the operator in which direction and to what angular extent the carriage has moved.

Once the carriage has moved to an angular extent to be determined by the operator, then, the switch 71 is manually moved to the right, this sequentially causing opening of the switch contact 77 and de-energization of the drive motor associated with the de-energized magnet, then opening of the contact 75, thus de-energizing the directional drive motor 14 associated with the still energized electromagnet 10, then energizing both of the electromagnets 10 in tandem, causing both of the electromagnets to clamp onto the ship's hull.

Continued movement of the switch bar 71 to the right then causes de-energization of the previously energized electromagnetic 10 while energization of the opposite electromagnet is maintained, and sequentially engages the contact 74 of the directional drive motor associated with the then energized electromagnet, and then engages the contact 76 associated with the drive motor 20 of the brush associated with the then de-energized electromagnet 10. Angular displacement of the carriage by means of the then energized directional drive motor, then produces rotational movement of the position switch 27 in order to give an indication at the surface of the position and extent of angular movement of the carriage by means of a second indicator 79 positioned at the surface.

If it is desired, for example, in the FIG. 6 embodiment that both of the scrubbing brushes be operated simultaneously, then, all that is required is a bridging of the contacts 76 and 77, one of the brush drive motors 20 then becoming redundant, in that the drive to both brushes is accomplished by a single drive motor 41.

While the various embodiments of the device previously discussed have required the use of electrically driven motors 20 and 41 for rotating the respective brushes, these can be substituted by air driven or hydraulically driven motors, the electrical circuit of FIG. 7 then being modified to control supply valves to the respective motors.

As illustrated in FIG. 7, conveniently ganged switches 80 can be provided in the electrical circuits of the motors 14 and 20 for reversing the direction of rotation of the respective motors, this giving added control to the operator in controlling the movements of the device. Similarly, switches 81 can be provided in the individual circuits of each of the selenoids 10, directional drive motors 14 and the drive motors 20 for the brushes, again, to give additional cntrol by the operator of the functioning of the device.

While the examples of the device discussed above are to be considered preferred embodiments, it would be understood that various modifications in the structures may be made within the scope of the invention as defined in the appended claims.

I claim:

1. An aquatic scrubbing device for attachment to a ferro-magnetic surface, comprising:

(1) a first electromagnet having a longitudinal axis;

(2) a second electromagnet having a longitudinal axis spaced from and parallel to the longitudinal axis of said first electromagnet;

(3) a first carriage interconnecting said electromagnets and supporting each said electromagnet for rotation about its longitudinal axis relative to said carriage;

(4) drive means for rotating each said electromagnet about its longitudinal axis;

(5) control means for selectively energizing said electromagnets and their associated drive means in repetitive sequence comprising:

(a) energization of both said electromagnets to cause said electromagnets to attach to said ferromagnetic surface, and de-energization of said drive means of both said electromagnets (b) subsequent de-energization of one of said electromagnets only and energization of the drive means of the other said electromagnet to cause said carriage to move arcuately about the longitudinal axis of said other electromagnet (c) subsequent de-energization of said drive means of said other electromagnet and energization of both said electromagnets (d) subsequent de-energization of the said other said electromagnet and energization of the drive means of said one electromagnet to cause said first carriage to move arcuately about the longitudinal axis of said one electromagnet; and, (6) rotary scrubbing means and associated drive means carried by said device.

2. The aquatic scrubbing device of claim 1, including a said rotary scrubbing means mounted co-axially on each said electromagnet for rotation relative thereto, and, a said associated drive means mounted on said first carriage and operative to rotate said rotary scrubbing means.

3. The aquatic scrubbing device of claim 1, in which said rotary scrubbing means are mounted on a secondary carriage journalled for rotation on said first carriage about an axis parallel to the axis of rotation of the respective electromagnets, and said drive means is operative to rotate said scrubbing means and simultaneously rotate said secondary carriage relative to said first carriage.

4. The aquatic scrubbing device of claim 3, including dual rotary scrubbing means mounted on said secondary carriage and each driven by the associated said drive means.

* * * * *